US008291531B2

(12) United States Patent
Kuo

(10) Patent No.: US 8,291,531 B2
(45) Date of Patent: Oct. 23, 2012

(54) SLEEPING PAD WITH PILLOW FORMED BY BENDING AND TEMPORARILY FIXING

(76) Inventor: Jen-Tsu Kuo, Changhua (TW)

( * ) Notice: Subject to any disclaimer, the term of this patent is extended or adjusted under 35 U.S.C. 154(b) by 25 days.

(21) Appl. No.: 13/027,272

(22) Filed: Feb. 15, 2011

(65) Prior Publication Data

US 2012/0204349 A1 Aug. 16, 2012

(51) Int. Cl.
*A47G 9/06* (2006.01)

(52) U.S. Cl. ..... 5/419; 5/733; 5/655.9; 5/740; 441/129; D21/809; 297/440.12

(58) Field of Classification Search ..... 5/417, 419, 5/420, 643, 731, 733, 740, 655.9, 656, 924, 5/953; 446/109, 114, 116, 124, 488; 441/129; D21/809; 297/440.12, DIG. 1
See application file for complete search history.

(56) References Cited

U.S. PATENT DOCUMENTS

| | | | | | |
|---|---|---|---|---|---|
| 924,893 | A * | 6/1909 | Doddridge | 5/491 |
| 4,006,503 | A * | 2/1977 | Wood | 441/129 |
| 4,634,393 | A * | 1/1987 | Wood | 441/129 |
| 4,869,553 | A * | 9/1989 | Powell | 297/377 |
| 5,212,842 | A * | 5/1993 | Glydon | 5/420 |
| D366,177 | S * | 1/1996 | Dean | D6/605 |
| D409,268 | S * | 5/1999 | O'Rourke | D21/809 |
| 6,785,923 | B2 * | 9/2004 | Karafa et al. | 5/733 |

* cited by examiner

*Primary Examiner* — Michael Trettel

(57) ABSTRACT

A rectangular sleeping pad includes a plurality of projections on one end; a plurality of through holes each correspondingly adjacent to the projection; a plurality of tongues each correspondingly distal the through hole; and a plurality of units each having a first slot at one side of the tongue and a second slot at the other side of the tongue, whereby partially pulling out the tongues will leave a plurality of spaces, and bending one end of the sleeping pad to insert the projections into the spaces, and inserting the tongues through the through holes will temporarily form a pillow.

1 Claim, 7 Drawing Sheets

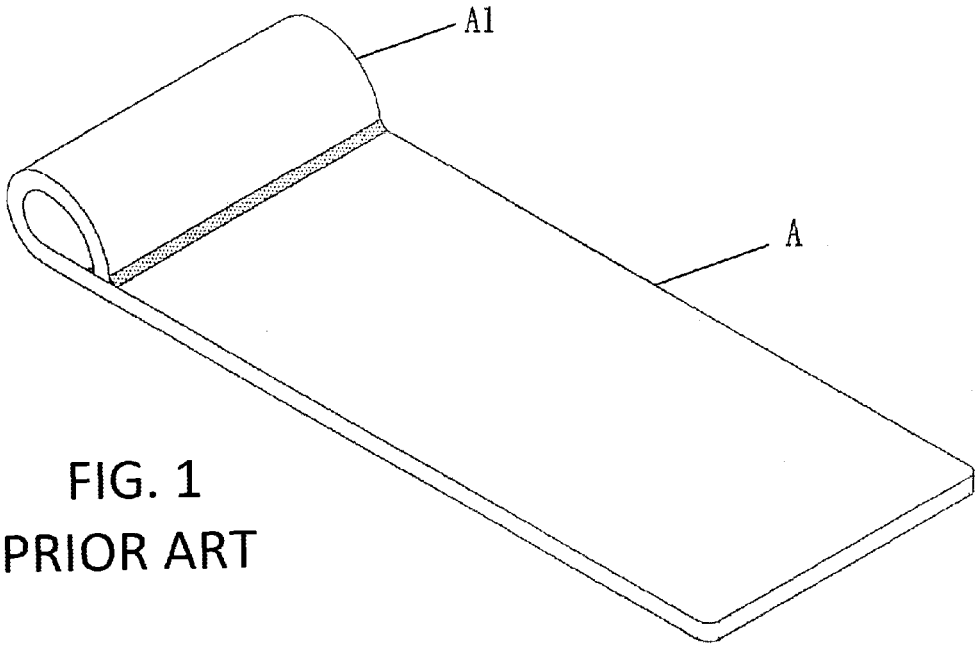
FIG. 1
PRIOR ART
FIG. 2
PRIOR ART
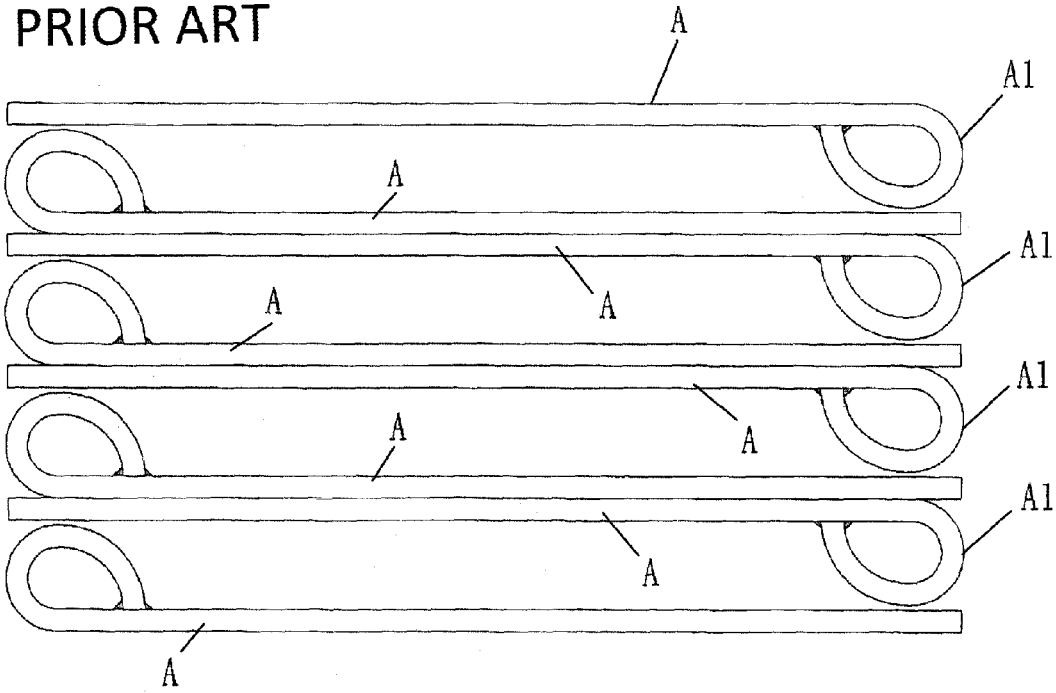

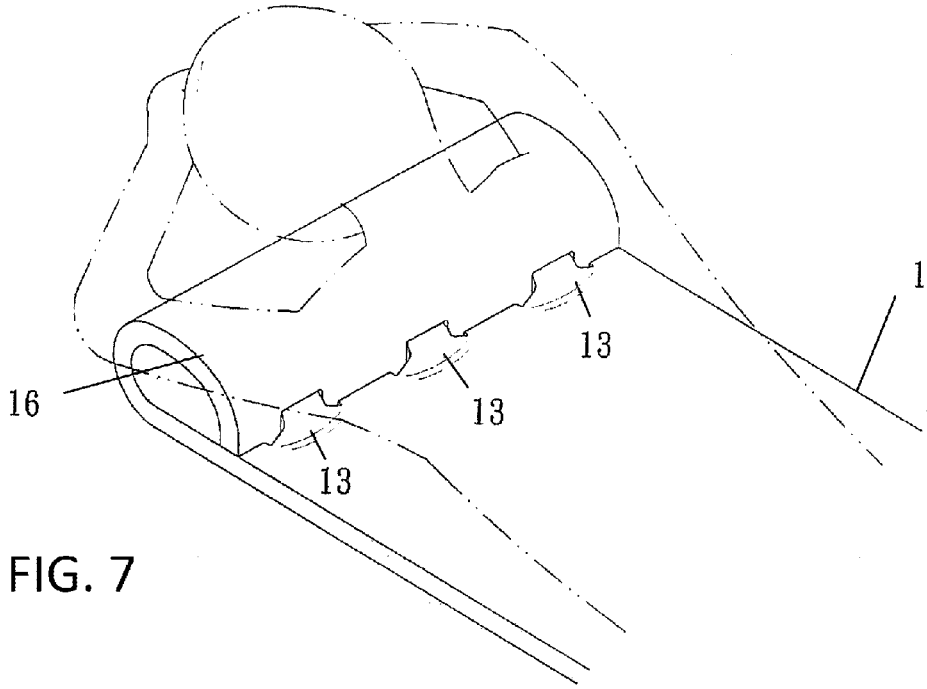
FIG. 7
FIG. 8
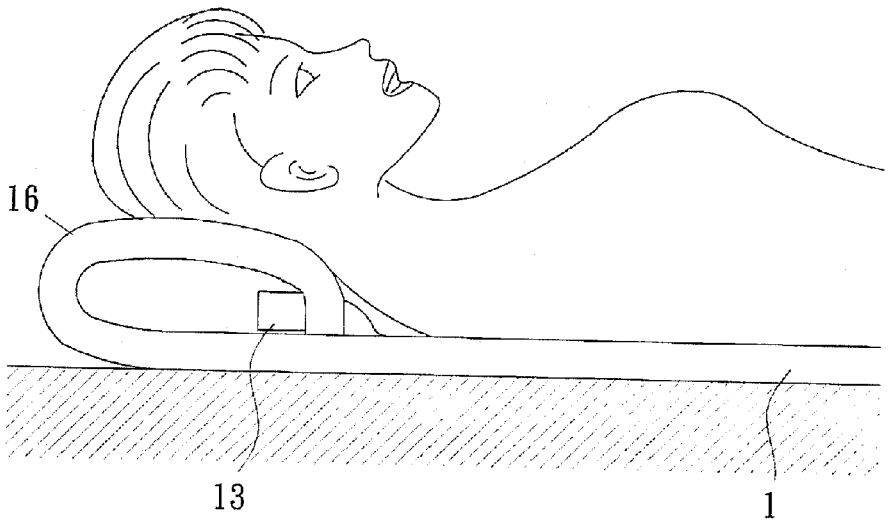

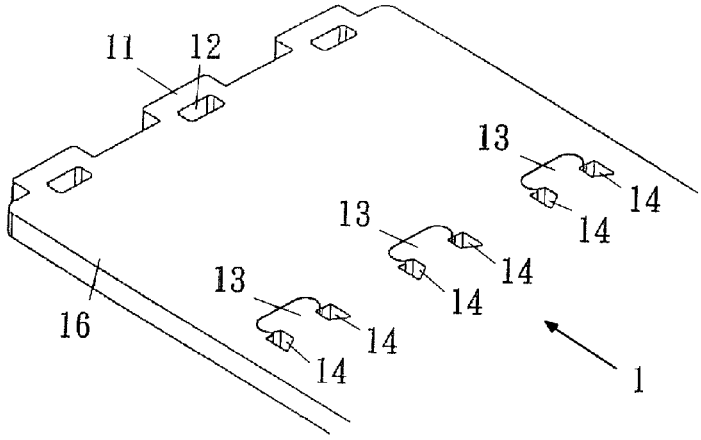
FIG. 11
FIG. 12
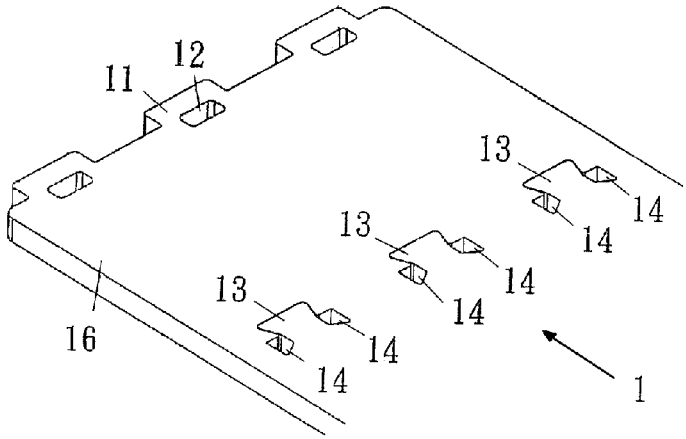
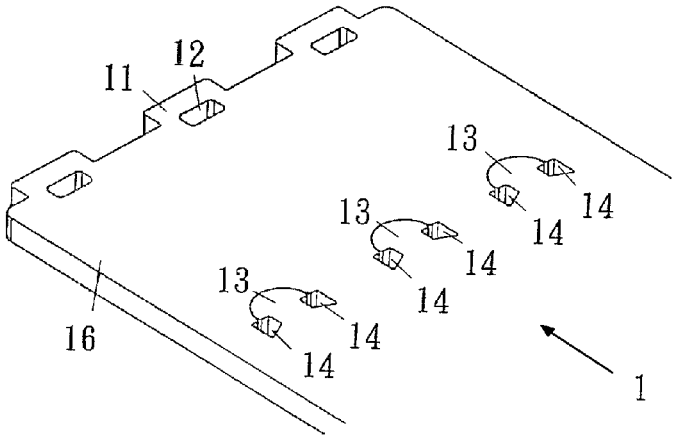
FIG. 13

SLEEPING PAD WITH PILLOW FORMED BY BENDING AND TEMPORARILY FIXING

BACKGROUND OF THE INVENTION

1. Field of Invention

The invention relates to sleeping pads and more particularly to a sleeping pad having a pillow formed by bending and temporarily fixing.

2. Description of Related Art

A typical sleeping pad A made of foam rubber is shown in FIGS. 1 and 2. One end of the rectangular sleeping pad A is bent and permanently secured to top surface thereof by applying adhesive thereto so as to form a pillow A1.

For storage of a plurality of sleeping pads A, any two adjacent sleeping pads A of them are stacked as below. The first sleeping pad A is disposed as that in FIG. 1. The second sleeping pad A is upside down with the other end rested on the pillow A1 of the first sleeping pad A.

However, a number of drawbacks have been found in the typical sleeping pad A. The storage space of a plurality of sleeping pads A is still large. The pillows A1 of the lower sleeping pads A may be permanently deformed. To the worse, the glued portions of pillows A1 of the lower sleeping pads A may be disengaged from top of the sleeping pad A, resulting in a failure of the desired function of the sleeping pad A. Thus, the need for improvement still exists.

SUMMARY OF THE INVENTION

It is therefore one object of the invention to provide a rectangular sleeping pad comprising a plurality of projections on one end; a plurality of through holes each correspondingly adjacent to the projection; a plurality of tongues each correspondingly distal the through hole; and a plurality of units each having a first slot at one side of the tongue and a second slot at the other side of the tongue, whereby partially pulling out the tongues will leave a plurality of spaces, and bending one end of the sleeping pad to insert the projections into the spaces, and inserting the tongues through the through holes will temporarily form a pillow.

The above and other objects, features and advantages of the invention will become apparent from the following detailed description taken with the accompanying drawings.

BRIEF DESCRIPTION OF THE DRAWINGS

FIG. 1 is a perspective view of a typical sleeping pad with permanently formed pillow;

FIG. 2 is a side elevation with four typical sleeping pads being stacked for storage;

FIG. 7 is an environmental view showing the face of a person rested on the pillow of the sleeping pad shown in FIG. 6;

FIG. 8 is an environmental view showing the back of the head of a person supported by the pillow of the sleeping pad shown in FIG. 6;

FIGS. 11 to 14 are fragmentary views of four sleeping pads according to second, third, fourth, and fifth preferred embodiments of the invention respectively.

DETAILED DESCRIPTION OF THE INVENTION

Figure 3:
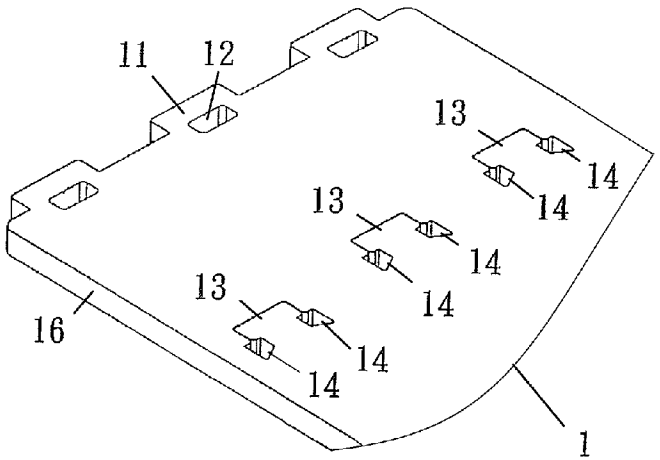
FIG. 3 is a fragmentary view of a sleeping pad according to a first preferred embodiment of the invention.
Figure 4:
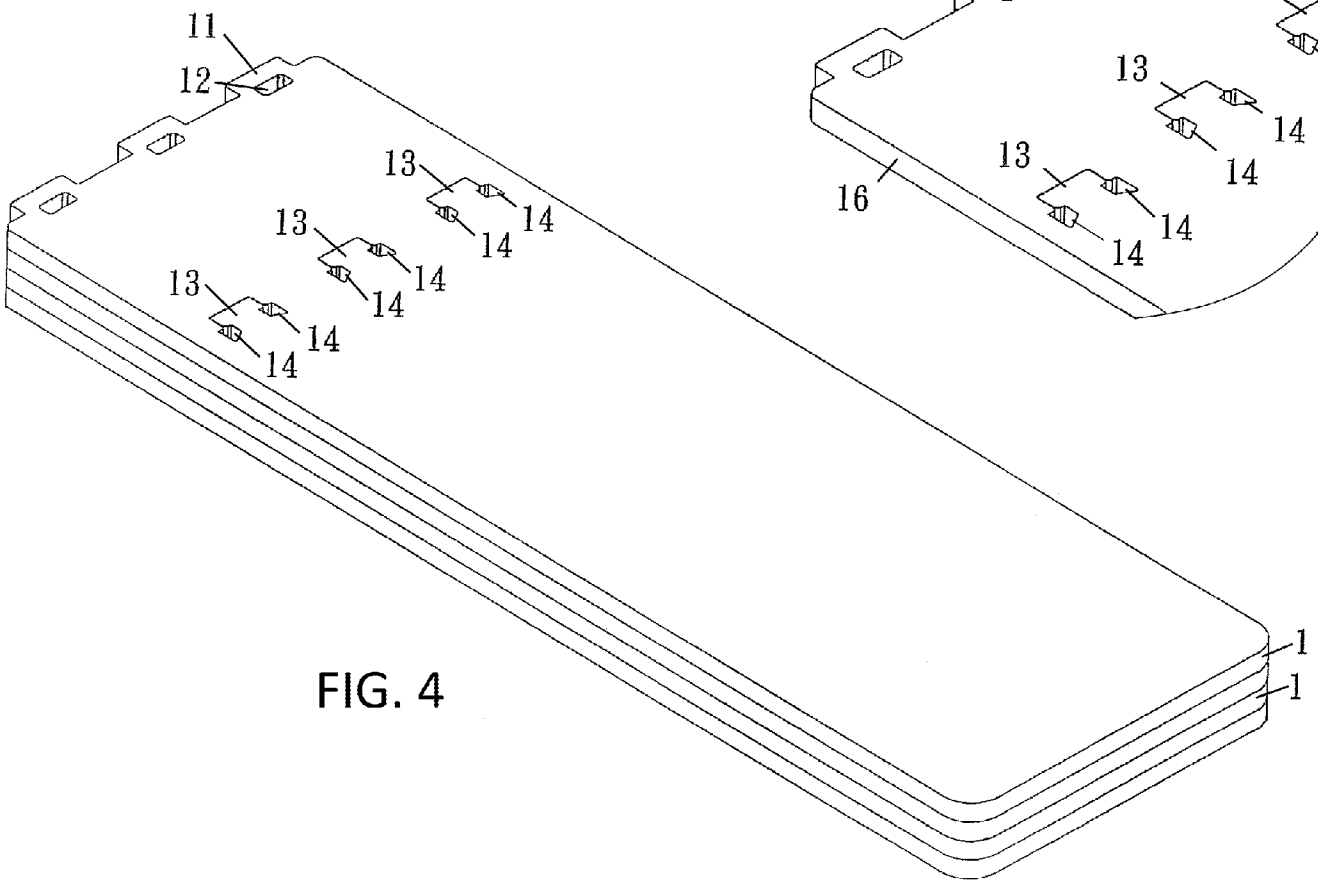
FIG. 4 is a perspective view of a plurality of stacked sleeping pads of FIG. 3.
Figure 5:
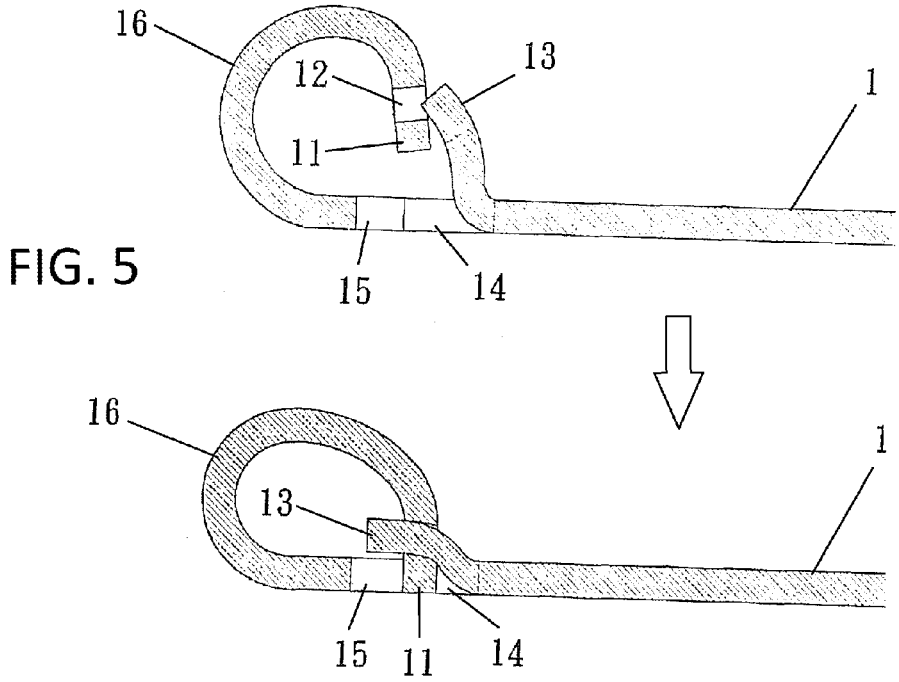
FIG. 5 is a longitudinal sectional view of FIG. 3 showing the forming of a pillow by bending and temporarily fixing.
Figure 6:
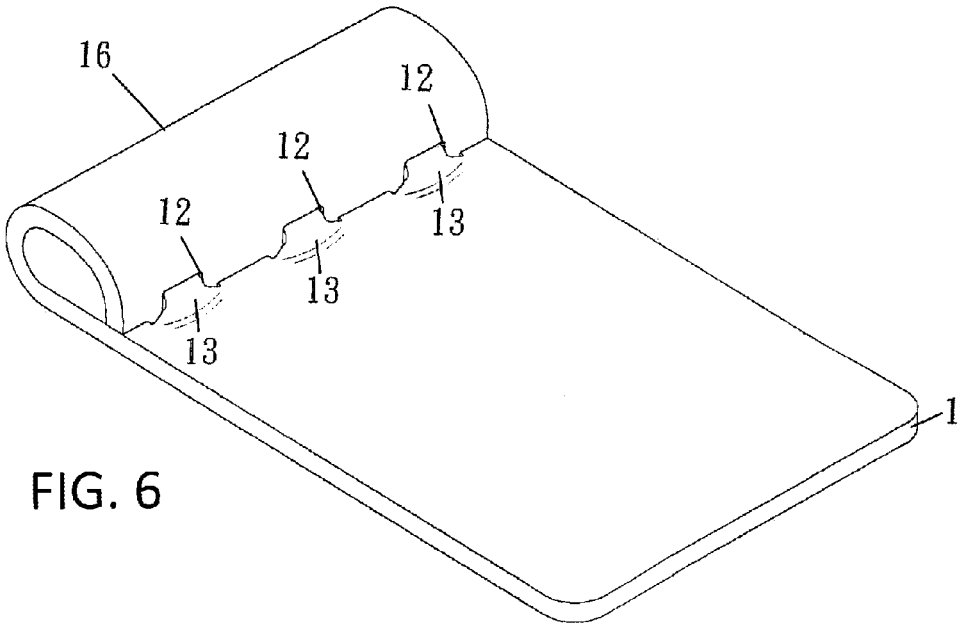
FIG. 6 is a perspective view the complete sleeping pad with the formed pillow of FIG. 5.

Referring to FIGS. 3 to 6, a rectangular sleeping pad 1 formed of resilient material (e.g., foam rubber) in accordance with a first preferred embodiment of the invention is shown. The sleeping pad 1 has a flat top and a flat bottom. The sleeping pad 1 comprises a pillow 16 at one end. A plurality of equally spaced projections 11 are formed along edge of one end of the pillow 16. A rectangular through hole 12 is formed adjacent to each projection 11. A plurality of equally spaced tongues 13 of substantially rectangular are formed at the other end of the pillow 16. A slot 14 is formed at either side of each tongue 13.

The forming of the pillow 16 with a closed loop longitudinal section will be described in detailed below. A person may upward partially pull out the tongues 13 to leave spaces 15. Next, the person may bend one end of the pillow 16 until the projections 11 are inserted into the spaces 15. Next, insert the tongues 13 through the through holes 12. As a result, the pillow 16 formed. Advantageously, the joining portions of the tongues 13, the through holes 12, the projections 11, and the spaces 15 are temporarily secured together.

A reverse operation of the sleeping pad 1 described in the above paragraph can return the sleeping pad 1 to its flat position.

Referring to FIG. 7, it shows the face of a person rested upon the pillow 16 of the sleeping pad 1.

Referring to FIG. 8, it shows the back of the head of a person supported by the pillow 16 of the sleeping pad 1.

Figure 9:
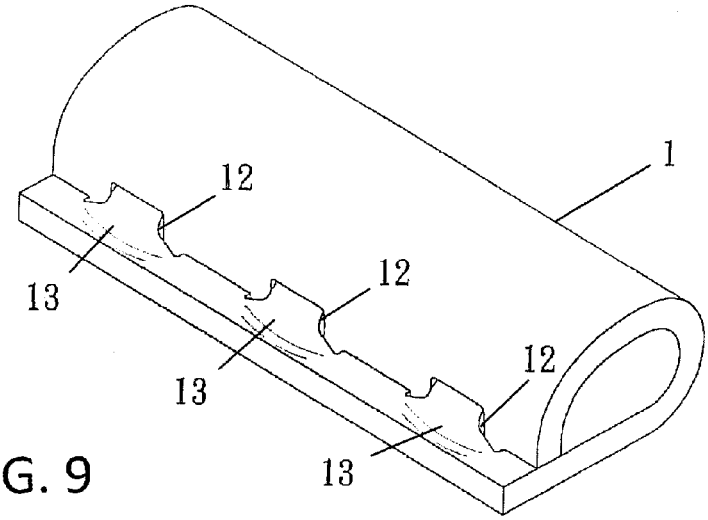
FIG. 9 is a perspective view of a short form of the sleeping pad of the first preferred embodiment of the invention being bent and temporarily fixed to form a pillow.
Figure 10:
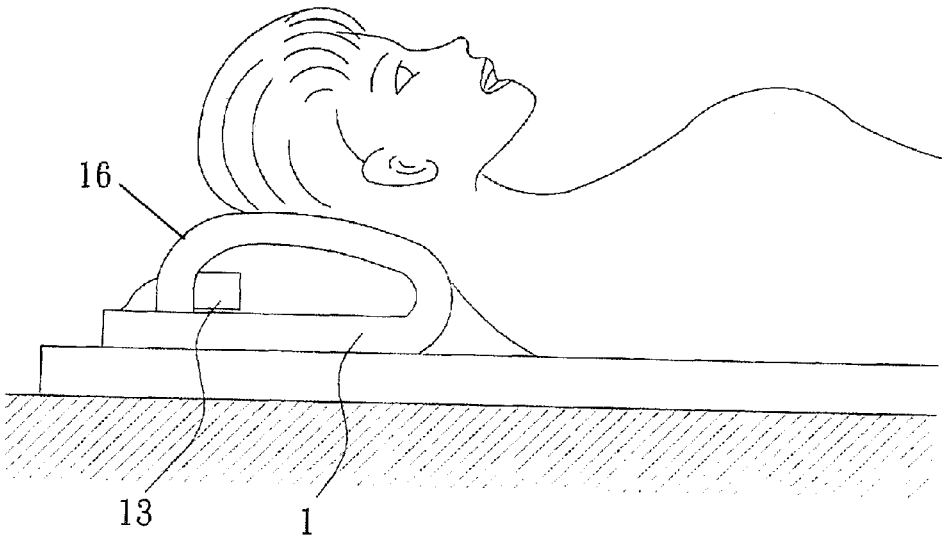
FIG. 10 is an environmental view showing the back of the head of a person supported by the pillow shown in FIG. 9.
Figure 14:
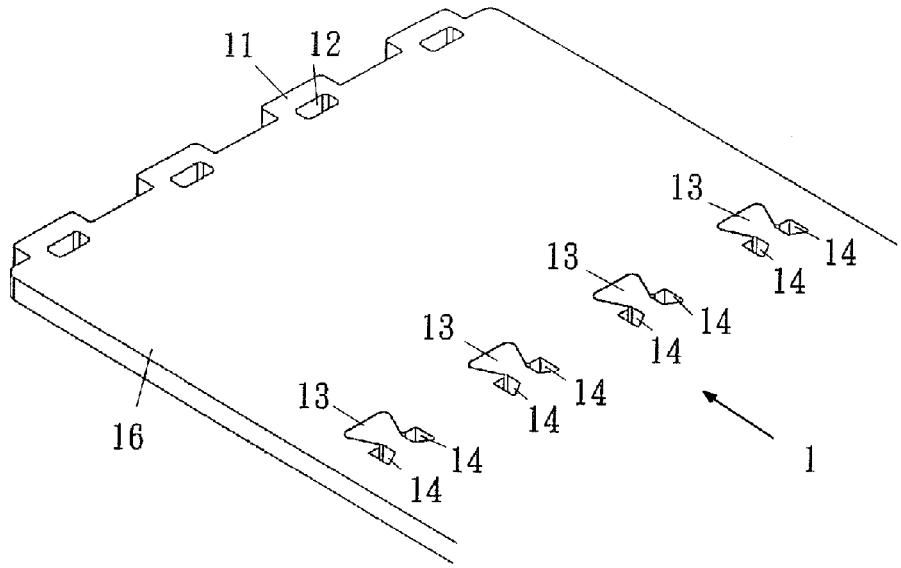

Referring to FIGS. 9 and 10, it shows a short form of the sleeping pad 1 of the first preferred embodiment of the invention being bent and temporarily fixed to form a pillow 16 for supporting the head of a person sleeping thereon.

Referring to FIGS. 11 to 14, four sleeping pads 1 according to second, third, fourth, and fifth preferred embodiments of the invention are shown. The characteristics of the second, third, and fifth preferred embodiments are that the tongues 13 have different shapes.

Figure 15:
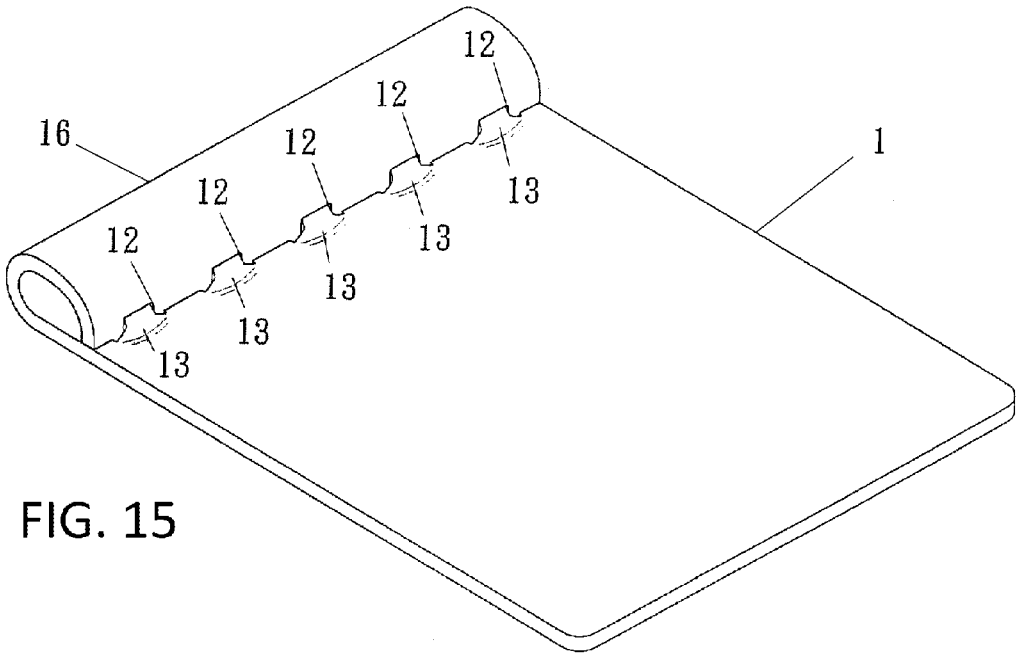
FIG. 15 is a perspective view of a sleeping pad with a pillow formed by bending and temporarily fixing according to a sixth preferred embodiment of the invention.

Referring to FIG. 15, it shows a sleeping pad 1 with a pillow 16 formed by bending and temporarily fixing according to a sixth preferred embodiment of the invention.

The sleeping pad of the invention can be alternatively used a water toy or flotation device.

Moreover, a plurality of sleeping pads of the invention can be stacked for storage with a minimum space being occupied.

While the invention has been described in terms of preferred embodiments, those skilled in the art will recognize that the invention can be practiced with modifications within the spirit and scope of the appended claims.

What is claimed is:

1. A rectangular sleeping pad forming a mat comprising:

a plurality of projections formed at one end of the mat;

a plurality of through holes formed from a top of the mat to a bottom of the mat, each through hole being correspondingly adjacent to the projection;

a plurality of tongues formed from the top of the mat to the bottom of the mat, each tongue being correspondingly distal the through hole; and a plurality of units each including a first slot disposed at one side of the tongue and formed from the top of the mat to the bottom of the mat, and a second slot disposed at the other side of the tongue and formed from the top of the mat to the bottom of the mat, whereby pulling the tongues will form a plurality of spaces in the mat; and bending one end of the mat, inserting the projections into the spaces, and inserting the tongues through the through holes will form a pillow on the mat.

* * * * *